US009153178B2

(12) United States Patent
Han

(10) Patent No.: US 9,153,178 B2
(45) Date of Patent: Oct. 6, 2015

(54) PIXEL, INCLUDING A LINK TRANSISTOR, DISPLAY DEVICE INCLUDING THE SAME, AND DRIVING METHOD THEREOF

(71) Applicant: Samsung Display Co., Ltd., Yongin, Gyeonggi-do (KR)

(72) Inventor: Sang-Myeon Han, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 130 days.

(21) Appl. No.: 13/776,373

(22) Filed: Feb. 25, 2013

(65) Prior Publication Data

US 2014/0139412 A1 May 22, 2014

(30) Foreign Application Priority Data

Nov. 20, 2012 (KR) ..... 10-2012-0131874

(51) Int. Cl.
*G09G 3/30* (2006.01)
*G09G 3/34* (2006.01)
*G09G 3/32* (2006.01)

(52) U.S. Cl.
CPC ..... *G09G 3/34* (2013.01); *G09G 3/3233* (2013.01); *G09G 2300/0861* (2013.01)

(58) Field of Classification Search
CPC ..... G09G 3/30–3/3291
USPC ..... 345/76, 77
See application file for complete search history.

(56) References Cited

U.S. PATENT DOCUMENTS

| | | | | |
|---|---|---|---|---|
| 7,176,912 | B2 * | 2/2007 | Kota et al. | 345/211 |
| 8,547,307 | B2 * | 10/2013 | Shirouzu et al. | 345/76 |
| 8,791,939 | B2 * | 7/2014 | Odawara et al. | 345/212 |
| 2002/0118150 | A1 * | 8/2002 | Kwon | 345/76 |
| 2009/0251452 | A1 * | 10/2009 | Kang et al. | 345/211 |
| 2010/0020059 | A1 * | 1/2010 | Suh | 345/212 |

FOREIGN PATENT DOCUMENTS

| | | | |
|---|---|---|---|
| KR | 10-2006-0023671 | A | 3/2006 |
| KR | 10-2006-0040907 | A | 5/2006 |
| KR | 10-2006-0064194 | A | 6/2006 |
| KR | 10-2011-0013693 | A | 2/2011 |

* cited by examiner

*Primary Examiner* — Roy Rabindranath
(74) *Attorney, Agent, or Firm* — Knobbe, Martens, Olson & Bear, LLP

(57) ABSTRACT

A display device including a display unit having a plurality of pixels is disclosed. In one aspect, at least one first pixel among the pixels includes: a first compensation capacitor including one electrode connected to a data line and the other electrode connected to a first node; a first switching transistor including a gate electrode configured to have a scan signal, one electrode connected to the first node, and the other electrode connected to a second node; a first driving transistor including a gate electrode connected to the second node, one electrode connected to a first power source voltage, and the other electrode connected to a first organic light emitting diode (OLED); and a first link transistor including a gate electrode configured to have a link control signal, one electrode connected to the data line, and the other electrode connected to the first power source voltage. Pixels of the type with four transistors may be alternated with pixels of the type having three transistors (no link transistor) according to a desired aspect ratio.

24 Claims, 14 Drawing Sheets

PIXEL, INCLUDING A LINK TRANSISTOR, DISPLAY DEVICE INCLUDING THE SAME, AND DRIVING METHOD THEREOF

CROSS-REFERENCE TO RELATED APPLICATIONS

This application claims priority to and the benefit of Korean Patent Application No. 10-2012-0131874 filed in the Korean Intellectual Property Office on Nov. 20, 2012, the entire contents of which are incorporated herein by reference.

BACKGROUND

1. Field

The disclosed technology relates to a pixel, a display device including the same, and a driving method thereof. More particularly, the disclosed technology relates to a pixel that is robust to a coupling or a leakage current caused by an external voltage, a display device including the same, and a driving method thereof.

2. Description of the Related Technology

An organic light emitting diode (OLED) display uses an OLED for controlling luminance by current or voltage. The OLED includes an anode layer and a cathode layer for forming an electric field, and an organic light emitting material electric field for emitting light by the electric field.

Generally, OLED displays are classified into one of two types: a passive matrix OLED (PMOLED) and an active matrix OLED (AMOLED) according to the driving circuitry.

Between them, in view of resolution, contrast, and operational speed, AMOLED drivers that are selectively turned on for every unit pixel find the most widespread commercial applications.

One pixel of an active matrix OLED includes an organic light emitting diode, a driving transistor that controls the amount of current that is supplied to the organic light emitting diode, and a switching transistor that transmits a data voltage that controls the driving transistor to adjust the amount of light that is generated by the OLED. The switching transistor is turned on by a scan signal of a gate-on voltage.

An OLED display may be operated with a simultaneous light emitting method in which all pixels simultaneously emit light after all pixels are programmed with data during one frame. The simultaneous light emitting method has merit in that it is not influenced by a voltage drop of a power source voltage due to wire length when programming the data.

However, this method has a short light emitting period compared with a sequential light emitting method in which a plurality of pixels sequentially emit light. Accordingly, to maintain the same luminance as in the sequential light emitting method, much current must flow to a plurality of pixels in the light emitting period. For this, the power output of a data driving IC (integrated circuit) must not only be expanded, but also a voltage difference between the power source voltage of both terminals of the pixel providing the driving current must be increased. If the voltage difference between the power source voltage of both terminals of the pixel providing the driving current is increased, the voltage drop caused by the wire is increased such that the power source voltage must be designed for the voltage difference between the power source voltage of both terminals of the pixel to have a margin of error.

Resultantly, the voltage difference between the power source voltage of both terminals of the pixel must be designed to meet this criteria, and accordingly power consumption is increased. Also, by considering the voltage drop of the wire length, although the power source voltage is set up or the voltage difference between the power source voltage of both terminals of the pixel is sufficient, uniformity of luminescence across the entire screen of pixels may decrease by the voltage drop of the power source voltage.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

A display device according to one aspect of the disclosed technology includes a display unit, wherein at least one first pixel among a plurality of pixels comprises: a first compensation capacitor including one electrode connected to a data line and the other electrode connected to a first node; a first switching transistor including a gate electrode configured to have a scan signal applied, one electrode connected to the first node, and the other electrode connected to a second node; a first driving transistor including a gate electrode connected to the second node, one electrode connected to a first power source voltage, and the other electrode connected to a first organic light emitting diode (OLED); and a first link transistor including a gate electrode configured to have a link control signal applied, one electrode connected to the data line, and the other electrode connected to the first power source voltage.

The first pixel further comprises a first compensation transistor including a gate electrode applied with the compensation control signal, one electrode connected to the second node, and the other electrode connected to the other electrode of the driving transistor.

The first pixel further comprises a first compensation transistor including a gate electrode applied with the compensation control signal, one electrode connected to the first node, and the other electrode connected to the other electrode of the driving transistor.

At least one second pixel among the plurality of pixels comprises: a second compensation capacitor including one electrode connected to the data line and the other electrode connected to a fourth node; a second switching transistor including a gate electrode configured to have the scan signal applied, one electrode connected to the fourth node, and the other electrode connected to a fifth node; and a second driving transistor including the gate electrode connected to the fifth node, one electrode connected to the first power source voltage, and the other electrode connected to a second organic light emitting diode (OLED).

The second pixel may further comprises: a second compensation transistor including a gate electrode configured to have a compensation control signal applied, one electrode connected to the fifth node, and the other electrode connected to the other electrode of the second driving transistor.

The second pixel further comprises a second compensation transistor including a gate electrode applied with a compensation control signal, one electrode connected to the fourth node, and the other electrode connected to the other electrode of the second driving transistor.

The first pixel and the second pixel may be alternately formed row by row in the display unit.

The first pixel of one row and the second pixel of a plurality of rows alternately formed in the display unit.

The first pixel and the second pixel alternately formed in the display unit in the row direction.

The first pixel and the second pixel alternately formed in the display unit in the column direction.

A method of driving a display device according to another aspect includes a plurality of pixels respectively including a compensation capacitor connected between a data line and a first node, a switching transistor connecting the first node and a second node according to a scan signal, a driving transistor controlling a driving current flowing from a first power source voltage to a third node connected to an organic light emitting diode (OLED) according to a voltage of the second node, a link transistor transmitting the first power source voltage to the data line according to a link control signal, and a compensation transistor connecting the second node and the third node according to a compensation control signal, the method comprising: a reset period in which the voltage of the second node is reset as a low level voltage and a voltage of the third node is reset as a voltage corresponding to a sum of a second voltage and a threshold voltage of the driving transistor; a scan period in which a voltage reflecting a data voltage and a threshold voltage of the driving transistor is stored to the compensation capacitor; and a light emitting period in which a plurality of pixels simultaneously emit light.

The reset period comprises: a period in which the link control signal and the scan signal are applied as the gate-on voltage and the first power source voltage is applied as the first voltage; and a period in which the voltage of the second node is decreased to the low level voltage by coupling due to the compensation capacitor.

The reset period comprises: a period in which the second power source voltage connected to a cathode of the organic light emitting diode (OLED) is applied as the low level voltage; a period in which the compensation control signal is applied as the gate-on voltage; and a period in which the voltage of the third node is reset as the low level voltage.

The reset period comprises: a period in which the compensation control signal is applied as the gate-off voltage; a period in which the second power source voltage is applied as the third voltage; a period in which the first power source voltage is applied as the first voltage; and a period in which a current flows from the third node to the first power source voltage such that the voltage of the third node is reset as a voltage corresponding to a sum of the second voltage and the threshold voltage of the driving transistor.

The scan period comprises: a period in which a scan signal of a gate-on voltage is sequentially applied to a plurality of scan lines connected to a plurality of pixels; a period in which a compensation control signal of the gate-on voltage is sequentially applied to a plurality of compensation control lines connected to a plurality of pixels; and a period in which a data signal is applied to the data line corresponding to the scan signal of the gate-on voltage.

The light emitting period comprises: a period in which a scan signal of the gate-on voltage is simultaneously applied to a plurality of scan lines; a period in which the link control signal is applied as the gate-on voltage; a period in which the first power source voltage is applied as the third voltage and the second power source voltage is applied as the first voltage; and a step in which the current flows to the organic light emitting diode (OLED) through the driving transistor.

A pixel according to another aspect comprising: a first compensation capacitor including one electrode connected to a data line and the other electrode connected to a first node; a first switching transistor including a gate electrode configured to have a scan signal applied, one electrode connected to the first node, and the other electrode connected to a second node; a first driving transistor including the gate electrode connected to the second node, one electrode connected to a first power source voltage, and the other electrode connected to a third node connected to a first organic light emitting diode (OLED); and a first link transistor configured to have a gate electrode applied with a link control signal, one electrode connected to the data line, and the other electrode connected to the first power source voltage.

A second compensation capacitor including one electrode connected to the data line and the other electrode connected to a fourth node; a second switching transistor including a gate electrode configured to have the scan signal applied, one electrode connected to the fourth node, and the other electrode connected to a fifth node; and a second driving transistor including the gate electrode connected to the fifth node, one electrode connected to the first power source voltage, and the other electrode connected to a sixth node connected to a second organic light emitting diode (OLED).

A first compensation transistor including a gate electrode configured to have the compensation control signal applied, one electrode connected to the second node, and the other electrode connected to the third node.

A second compensation transistor including a gate electrode configured to have the compensation control signal applied, one electrode connected to the fifth node, and the other electrode connected to the sixth node.

A second compensation transistor including a gate electrode configured to have the compensation control signal applied, one electrode connected to the fourth node, and the other electrode connected to the sixth node.

A first compensation transistor including a gate electrode configured to have the compensation control signal applied, one electrode connected to the first node, and the other electrode connected to the third node.

A second compensation transistor including a gate electrode configured to have the compensation control signal applied, one electrode connected to the fifth node, and the other electrode connected to the sixth node.

A second compensation transistor including a gate electrode configured to have the compensation control signal applied, one electrode connected to the fourth node, and the other electrode connected to the sixth node.

At least one of the first switching transistor, the first driving transistor, the first link transistor, the second switching transistor, the second driving transistor, and the second link transistor is an oxide thin film transistor.

In various embodiments, the voltage drop of the power source voltage caused by wire length resistance may be reduced, and accordingly uniformity of screen luminance. Also, the voltage used by the pixel can be reduced, and accordingly power consumption of the display device is reduced.

DETAILED DESCRIPTION OF CERTAIN INVENTIVE EMBODIMENTS

Figure 1:
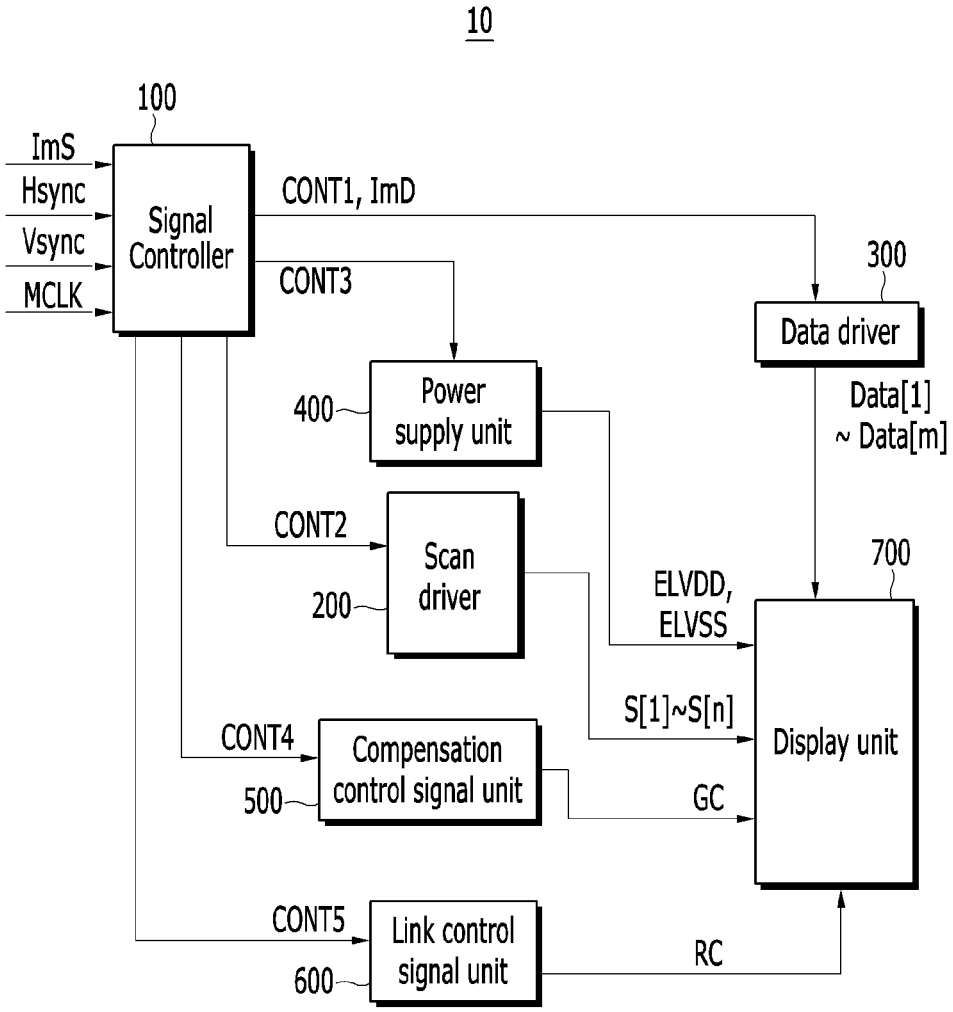
FIG. 1 is a block diagram of a display device according to an exemplary embodiment of the disclosed technology.

The disclosed technology will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Furthermore, with exemplary embodiments of the disclosed technology, detailed description is given for the constituent elements in the first exemplary embodiment with reference to the relevant drawings by using the same reference numerals for the same constituent elements, while only different constituent elements from those related to the first exemplary embodiment are described in other exemplary embodiments.

Parts that are irrelevant to the description are omitted in order to clearly describe the disclosed technology, and like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment of the disclosed technology.

Referring to FIG. 1, a display device 10 includes a signal controller 100, a scan driver 200, a data driver 300, a power supply unit 400, a compensation control signal unit 500, a link control signal unit 600, and a display unit 700.

The signal controller 100 receives a video signal ImS and a synchronization signal input from an external device. The input video signal ImS includes luminance information on a plurality of pixels. The luminance has a predetermined number of grays, for example, $1024=2^{10}$, $256=2^{8}$, or $64=2^{6}$. The synchronization signal includes a horizontal synchronization signal Hsync, a vertical synchronization signal Vsync, and a main clock signal MCLK.

The signal controller 100 generates first to sixth driving control signals CONT1, CONT2, CONT3, CONT4, and CONT5, and an image data signal ImD according to the video signal ImS, the horizontal synchronization signal Hsync, the vertical synchronization signal Vsync, and the main clock signal MCLK.

The signal controller 100 generates image data signal ImD by dividing the video signal ImS into a frame unit according to the vertical synchronization signal Vsync and dividing the image data signal ImS into a scan line unit according to the horizontal synchronization signal Hsync. The signal controller 100 transmits the image data signal ImD along with the first driving control signal CONT1 to the data driver 300.

The display unit 800 is a display area including a plurality of pixels. A plurality of scan lines that are substantially extended in a row direction and generally parallel with each other, and a plurality of data lines, a plurality of power lines, a plurality of compensation control lines, and a plurality of link control lines that are substantially extended in a column direction and generally parallel with each other are formed in the display unit 700 to be connected to the plurality of pixels. The plurality of pixels are arranged substantially in a matrix format.

The scan driver 200 is connected to a plurality of scan lines, and generates a plurality of scan signals S[1]-S[n] according to the second driving control signal CONT2. The scan driver 200 may sequentially apply the scan signals S[1]-S[n] of the gate-on voltage to a plurality of scan lines.

The data driver 300 is connected to a plurality of data lines, and samples and holds the image data signal ImD input according to the first driving control signal CONT1 and transmits a plurality of data signals data[1]-data[m] to a plurality of data lines. The data driver 300 applies the data signals data[1]-data[m] having a predetermined voltage range to a plurality of data lines by corresponding to the scan signals S[1]-S[n] of the gate-on voltage.

The power supply unit 400 determines a level of the first power source voltage ELVDD and the second power source voltage ELVSS according to the third driving control signal CONT3 to supply the level to the power source line connected to a plurality of pixels. The first power source voltage ELVDD and the second power source voltage ELVSS provide the driving current of the pixel.

The compensation control signal unit 500 determines the level of the compensation control signal GC according to the fourth driving control signal CONT4 to apply it to a compensation control line connected to the pixels.

The link control signal unit 600 determines a level of a link control signal RC according to the fifth driving control signal CONT5, and applies it to a link control line connected to at least a portion of the pixels.

Figure 2:
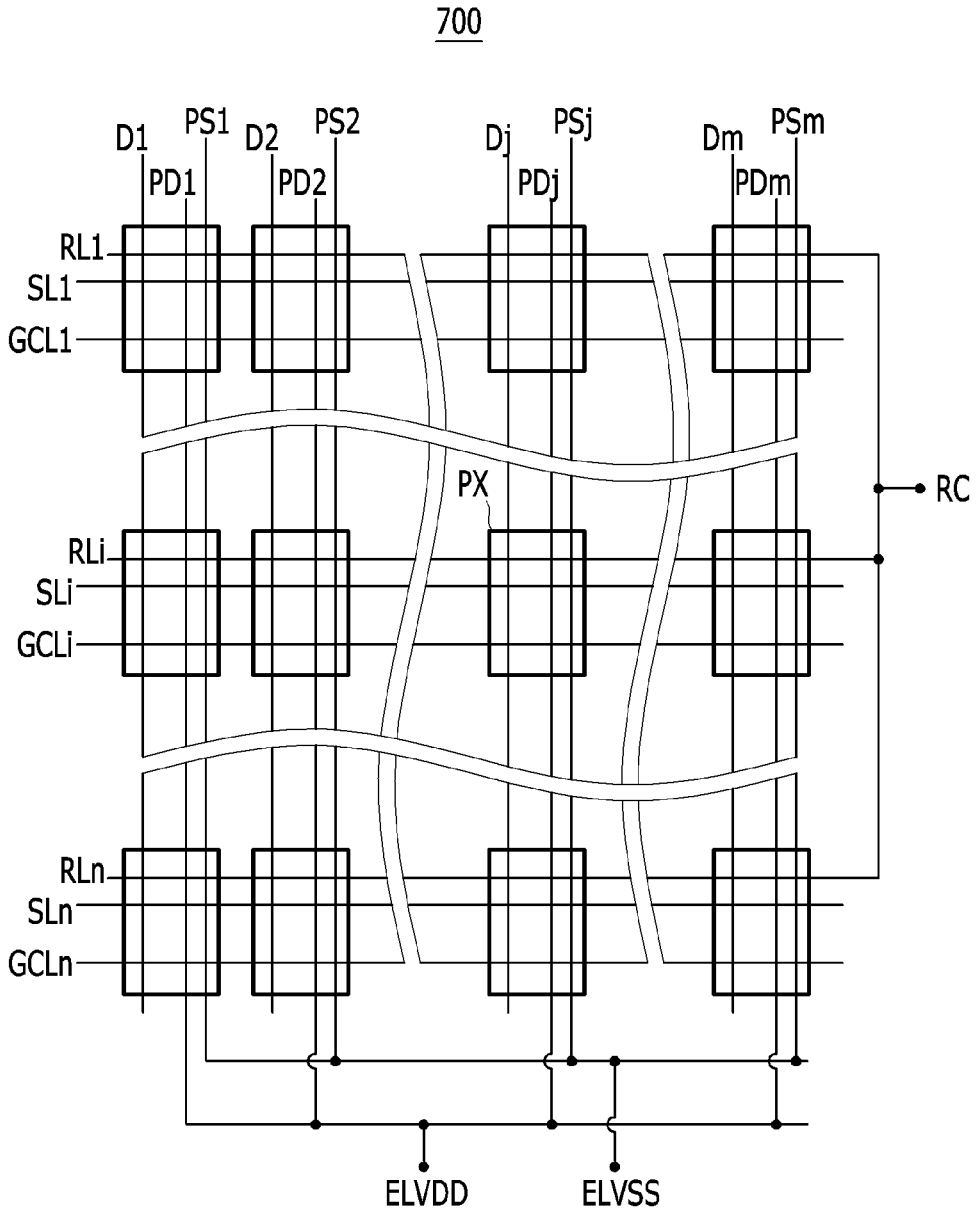
FIG. 2 is a block diagram of a display unit according to an exemplary embodiment of the disclosed technology.

FIG. 2 is a block diagram of a display unit according to an exemplary embodiment of the disclosed technology.

Referring to FIG. 2, a plurality of scan lines SL1-SLn approximately extend in the row direction, and a plurality of data lines D1-Dm approximately extend in the column direction.

A plurality of power source lines include power source lines PD1-PDm of the first power source voltage ELVDD and power source lines PS1-PSm of the second power source voltage ELVSS. The plurality of power source lines PD1-PDm and PS1-PSm will generally extend in the column direction. Here, the plurality of power source lines PD1-PDm and PS1-PSm extend in the column direction, however in other embodiments the plurality of power source lines will extend in the row direction.

A plurality of compensation control lines GCL1-GCL2 approximately extend in the row direction.

A plurality of link control lines RL1-RLn may be formed to approximately extend in the column direction. Here, the plurality of link control lines RL1-RLn extend in the column direction, however in other embodiments the plurality of link control lines will extend in the row direction.

A plurality of pixels PX are formed in crossing positions of the scan lines SL1-SLn, the data lines D1-Dm, the power source lines PD1-PDm and PS1-PSm, the compensation control lines GCL1-GCL2, and the link control lines RL1-RLn, and are generally arranged in an approximately matrix shape.

Figure 3:
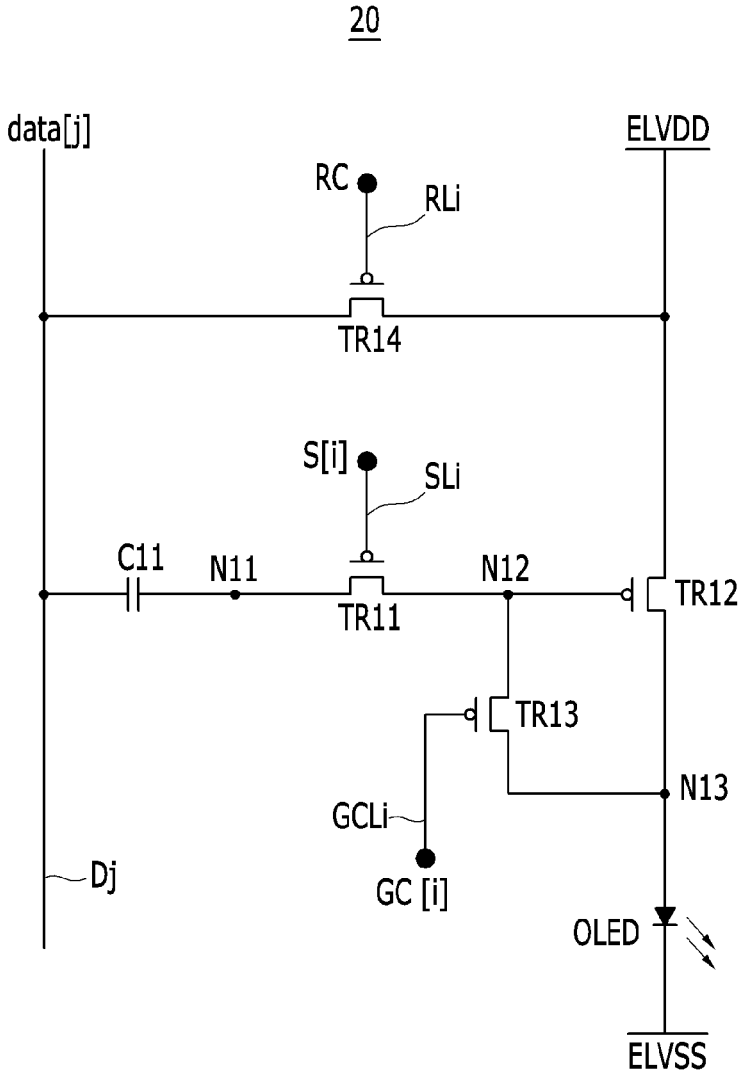
FIG. 3 is a circuit diagram of a pixel according to an exemplary embodiment of the disclosed technology.

FIG. 3 is a circuit diagram of an example of a pixel according to an exemplary embodiment of the disclosed technology. Only one pixel among the pixels included in the display device 10 of FIG. 1 is illustrated.

Referring to FIG. 3, the pixel 20 includes a switching transistor TR11, a driving transistor TR12, a compensation transistor TR13, a link transistor TR14, a compensation capacitor C11, and an organic light emitting diode (OLED).

The switching transistor TR11 has its gate electrode connected to the scan line SLi, one electrode connected to the first node N11, and the other electrode connected to the second node N12. The switching transistor TR11 is turned on by the scan signal S[i] of the gate-on voltage applied to scan line SLi to electrically connect the first node N11 to the second node N12.

The driving transistor TR12 has its gate electrode connected to the second node N12, one electrode connected to the first power source voltage ELVDD, and the other electrode connected to the third node N13. The anode of the organic light emitting diode (OLED) is connected to the third node N13. The driving transistor TR12 is turned off by the voltage of the second node N12 to control the driving current supplied to the organic light emitting diode (OLED) from the first power source voltage ELVDD.

The compensation transistor TR13 has its gate electrode connected to a compensation control line GCLi, one electrode connected to the second node N12, and the other electrode connected to the third node N13. The compensation transistor TR13 is turned on by the compensation control signal GC of the gate-on voltage to electrically connect the second node N12 to the third node N13.

The link transistor TR14 has its gate electrode connected to the link control line RLi, one electrode connected to the data line Dj, and the other electrode connected to the first power source voltage ELVDD. The link transistor TR14 is turned on by a link control signal RC of the gate-on voltage applied to the link control line RLi to transmit the first power source voltage ELVDD to the data line Dj.

The compensation capacitor C11 has one electrode connected to the data line Dj and the other electrode connected to the first node N11.

The organic light emitting diode (OLED) includes the anode connected to the third node N13 and a cathode connected to the second power source voltage ELVSS. In many embodiments, the organic light emitting diode OLED emits light of one of several primary colors. The primary colors include, for example, three primary colors of red, green, and blue, and a desired color is displayed with a spatial or temporal sum of the three primary colors.

The switching transistor TR11, the driving transistor TR12, the compensation transistor TR13, and the link transistor TR14 may be p-channel field effect transistors. In this case, the gate-on voltage that turns on the switching transistor TR11, the driving transistor TR12, the compensation transistor TR13, and the link transistor TR14 is a low level voltage, and the gate-off voltage that turns them off is a high level voltage.

Herein, the p-channel field effect transistor is illustrated, but at least one of the switching transistor TR11, the driving transistor TR12, the compensation transistor TR13, and the link transistor TR14 may be an n-channel field effect transistor. In this case, the gate-on voltage turning on the n-channel field effect transistor is a logic high level voltage, and the gate-off voltage turning off the n-channel field effect transistor is a logic low level voltage.

The switching transistor TR11, the driving transistor TR12, the compensation transistor TR13, and the link transistor TR14 may be made of one of an amorphous silicon thin film transistor (a-Si TFT), a low temperature polysilicon (LTPS) thin film transistor, and an oxide thin film transistor (oxide TFT).

The oxide thin film transistor may be formed of an oxide based on titanium (Ti), hafnium (Hf), zirconium (Zr), aluminum (Al), tantalum (Ta), germanium (Ge), zinc (Zn), gallium (Ga), tin (Sn), or indium (In), or as a composite oxide thereof, one of zinc oxide (ZnO), indium-gallium-zinc oxide (InGaZnO4), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O), as an activation layer.

Figure 4:
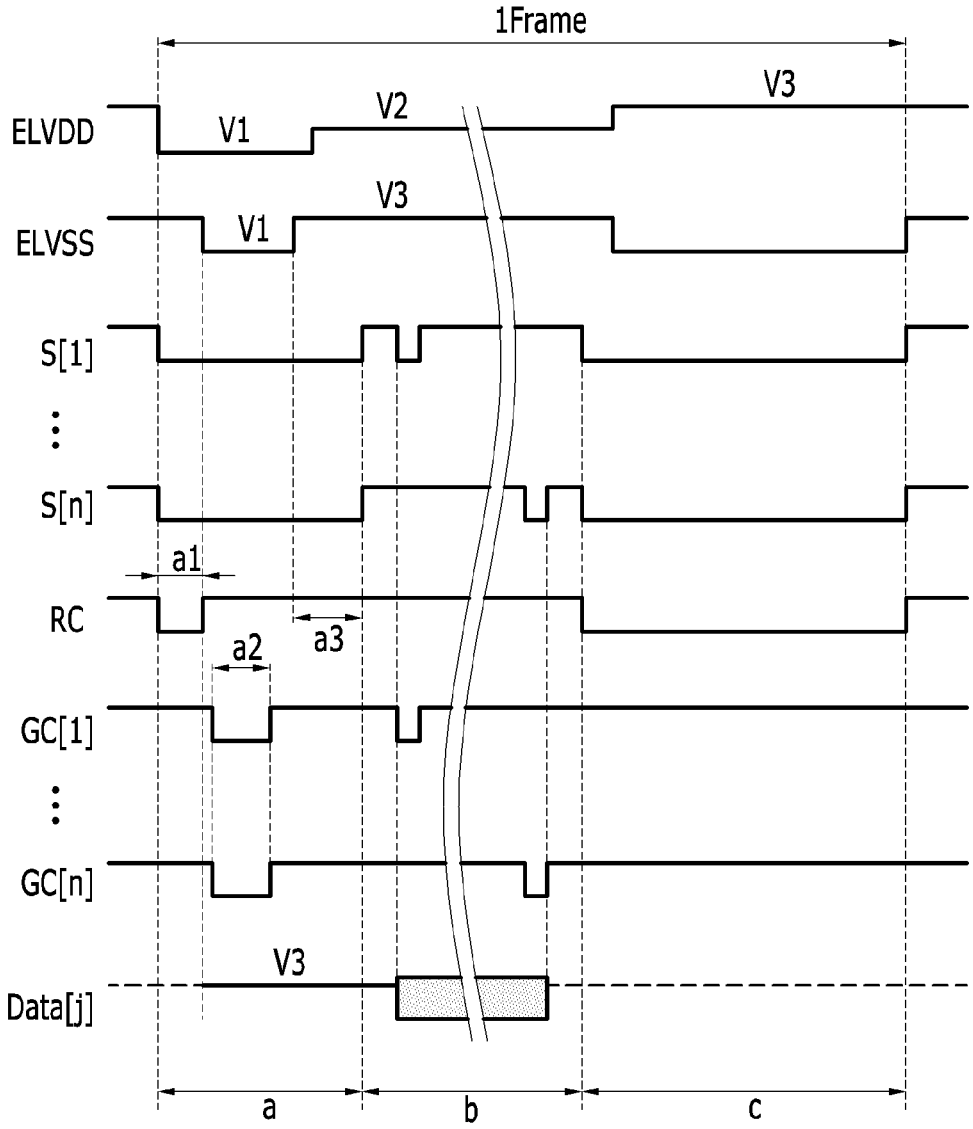
FIG. 4 is a timing diagram of a driving method of a display device according to an exemplary embodiment of the disclosed technology.

FIG. 4 is a timing diagram of a driving method of a display device according to an exemplary embodiment of the disclosed technology.

Referring to FIG. 3 and FIG. 4, one frame period in which one image is displayed to the display unit 700 includes a reset period (a) resetting the driving voltage of the organic light emitting diode (OLED) of the pixel, a scan period (b) in which the threshold voltage of the driving transistor of the pixel is compensated and the data signal is programmed to at least a portion of the pixels, and a light emitting period (c) in which at least a portion of the pixels emit light corresponding to the programmed data signal.

Hereafter, the first voltage V1 means a low level voltage, the third voltage V3 means a high level voltage, and the second voltage V2 means a middle level voltage that is higher than the first voltage V1 and is lower than the third voltage V3. For example, the first voltage V1 may be 0 V, the second voltage V2 may be 8 V, and the third voltage V3 may be 12 V.

During a first period a1 included in the reset period (a), a plurality of scan signals S[1]-S[n] and a link control signal RC are applied as a low level voltage, and a plurality of compensation control signals GC[1]-GC[n] are applied as a high level voltage. At this time, the first power source voltage ELVDD is applied as the first voltage V1, and the second power source voltage ELVSS is applied as the third voltage V3. The switching transistor TR11 and the link transistor TR14 are turned on. As the switching transistor TR11 is turned on, the first node N11 and the second node N12 are connected. As the link transistor TR14 is turned on, the first power source voltage ELVDD of the first voltage is transmitted to the data line Dj. As the link transistor TR14 is turned on in a light emitting period (c) of the previous frame, the data line Dj is applied with the first power source voltage ELVDD of the third voltage V3. That is, the voltage of the data line Dj is at a state of having the third voltage V3. If the first power source voltage ELVDD of the first voltage V1 is transmitted to the data line Dj in the first period a1, the voltage of the data line Dj is changed from the third voltage V3 to the first voltage V1, and the voltage of the first node N11 and the second node N12 is decreased into the low level voltage due to the coupling by a compensation capacitor C11.

During the second period a2 of the reset period (a), a plurality of scan signals S[1]-S[n] and a plurality of compensation control signals GC[1]-GC[n] are applied as the low level voltage, and the link control signal RC is applied as the high level voltage. At this time, the first power source voltage ELVDD and the second power source voltage ELVSS are applied as the first voltage V1. The switching transistor TR11 and the compensation transistor TR13 are turned on. As the switching transistor TR11 is turned on, the first node N11 and the second node N12 are connected. As the compensation transistor TR13 is turned on, the second node N12 and the third node N13 are connected. The voltages of the first to third nodes N1, N2, and N3 are reset as the low level voltage.

The data signal data[j] is not applied in the first period a1 such that the link control signal RC is applied as the low level voltage. The data signal data[j] is applied as the third voltage V3 after the first period a1. Although the data signal data[j] is applied as the third voltage V3 after the first period a1 such that the voltage of the first node N11 and the second node N12 is increased by the coupling due to the compensation capacitor C11, as the second power source voltage ELVSS is decreased to the first voltage V1, the voltage of the third node N13 is decreased to the low level voltage by the coupling due to parasitic capacitance of the organic light emitting diode (OLED), and as the first to third nodes N1, N2, and N3 are connected in the second period a2, the voltage of the first node N11 and the second node N12 is decreased to the low level voltage.

During the third period a3 included in the reset period (a), the plurality of scan signals S[1]-S[n] are applied as the low level voltage, and the plurality of compensation control signals GC[1]-GC[n] and the link control signal RC are applied as the high level voltage. At this time, the second power source voltage ELVDD is changed from the first voltage V1 into the third voltage V3. If the second power source voltage ELVDD is changed into the third voltage V3, the voltage of the third node N13 is increased by the parasitic capacitance of the organic light emitting diode (OLED). At this time, the compensation transistor TR13 is in the turn-off state, and the voltage of the second node N12 is maintained as the low level voltage such that the driving transistor TR12 is turned on by the voltage difference between the gate-the source. The current flows from the third node N13 to the first power source voltage ELVDD through the turned on driving transistor TR12, and the voltage of the third node N13 is decreased. At this time, the first power source voltage ELVDD is applied as the second voltage V2. As the first power source voltage ELVDD is applied as the second voltage V2, the voltage of the third node N13 is decreased to the voltage (V2+Vth) that is higher than the second voltage V2 by a threshold voltage Vth of the driving transistor TR12.

As described above, the gate voltage of the driving transistor TR12 is reset to the voltage through the low reset period (a), and the anode voltage of the organic light emitting diode (OLED) is reset as the voltage V2+Vth.

During the scan period (b), the plurality of scan signals S[1]-S[n] are sequentially applied as the low level voltage to turn on the switching transistor TR11. Also, the plurality of compensation control signals GC[1]-GC[n] are sequentially applied as the low level voltage to turn on the compensation transistor TR13. At this time, the first power source voltage ELVDD is applied as the second voltage V2, and the second power source voltage ELVSS is applied as the third voltage V3. The data signal data[j] is applied to the data line Dj while the switching transistor TR11 and the compensation transistor TR13 are turned on. As the switching transistor TR11 is turned on, the first node N11 and the second node N12 are connected. As the compensation transistor TR13 is turned on, the first node N11 is transmitted with the voltage V2+Vth. The data signal data[j] is applied to one electrode of the compensation capacitor C11 and the other electrode is applied with the voltage V2+Vth such that the compensation capacitor C11 stores the voltage V2+Vth-data. The "data" is the data voltage of the data signal data[j]. After the voltage V2+Vth-data is stored to the compensation capacitor C11, if the switching transistor TR11 is turned off, the first node N11 enters the floating state, and although the voltage of the data line Dj is changed later, the voltage V2+Vth-data stored to the first capacitor C11 is maintained.

As described above, the voltage (V2+Vth-data) reflecting the data voltage data and the threshold voltage (Vth) of the driving transistor TR12 is stored to the compensation capacitor C11 during the scan period (c).

During the light emitting period (c), the plurality of scan signals S[1]-S[n] are simultaneously applied as the low level voltage, and the link control signal RC is applied as the low level voltage. At this time, the plurality of compensation control signals GC[1]-GC[n] are applied as the high level voltage. Also, the data signal data[j] is not applied. When the link control signal RC is applied as the low level voltage such that the link transistor TR14 is turned on, the first power source voltage ELVDD is in the state of the second voltage V2. The second voltage V2 is transmitted to the data line Dj through the turned on link transistor TR14. If the voltage of the data line Dj becomes the second voltage V2, the voltage of the first node N11 becomes the voltage (V2+Vth-data)+V2 by the coupling of the compensation capacitor C11. The switching transistor TR11 is in the turned on state such that the voltage of the second node N12 also becomes the voltage (V2+Vth-data)+V2. At this time, the voltage Vgs of the driving transistor TR12 becomes Vgs=(V2+Vth-data)+V2−V2=V2+Vth-data. The voltage Vgs is a voltage difference between the gate-the source of the driving transistor TR12. Next, as the first power source voltage ELVDD is increased to the third voltage V3 and the second power source voltage ELVSS is decreased to the first voltage, the current flows to the organic light emitting diode (OLED) through the driving transistor TR12. Although the first power source voltage ELVDD is increased to the third voltage V3, the gate and the source of the driving transistor TR12 are connected by the switching transistor TR11, the compensation capacitor C11, and the link transistor TR14 such that the voltage Vgs of the driving transistor TR12 is maintained as it is. The current flowing to the organic light emitting diode (OLED) through the driving transistor TR12 becomes $I=k(Vgs-Vth)^2=k(V2+Vth\text{-}data-Vth)^2=k(V2\text{-}data)^2$. Here, k is a parameter determined according to a characteristic of the driving transistor TR12. That is, the organic light emitting diode (OLED) emits light with a luminance corresponding to the data voltage data regardless of the threshold voltage Vth of the driving transistor TR12.

As described above, the link transistor TR14 is turned on during the light emitting period (c) in which at least a portion of the pixels emit light such that the data line Dj is electrically connected to the first power source voltage ELVDD. Accordingly, the current flowing from the first power source voltage ELVDD flows through the data line Dj that occupies a significant area in the display unit 700 such that the voltage drop of the power source voltage by the wire is remarkably reduced. Accordingly, in various embodiments, the degradation in photo-characteristic uniformity of the screen caused by a non-uniform distribution of the first power source voltage ELVDD in the display unit 700 by the voltage drop of the power source voltage is reduced.

Also, the gate voltage of the driving transistor TR12 is interlocked to the first power source voltage ELVDD of each pixel such that the gate-source voltage Vgs of the driving transistor TR12 being changed by the voltage drop of the first power source voltage ELVDD may be prevented.

Also, the described pixel only uses one capacitor which occupies a large area in the pixel. Since the circuitry space occupied by capacitors largely influence the size of the aperture ratio, a higher aperture ratio of the display device 10 is obtained.

Figure 5:
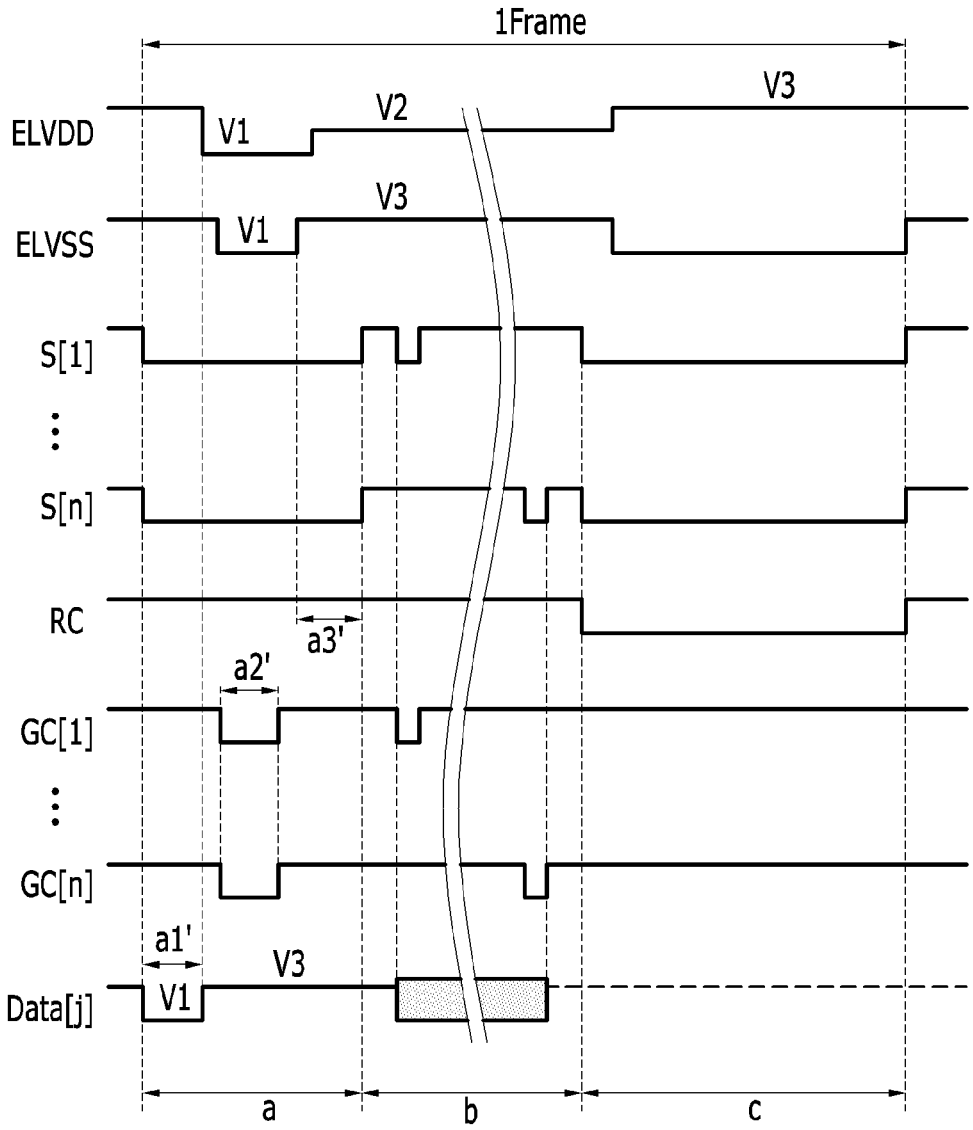
FIG. 5 is a timing diagram of a driving method of a display device according to another exemplary embodiment of the disclosed technology.

FIG. 5 is a timing diagram of a driving method of a display device according to another exemplary embodiment of the disclosed technology.

Referring to FIG. 3 and FIG. 5, during the first period (a1') included in the reset period (a), a plurality of scan signals S[1]-S[n] are applied as the low level voltage, and the link control signal RC and a plurality of compensation control signals GC[1]-GC[n] are applied as the high level voltage. At this time, the first power source voltage ELVDD and the second power source voltage ELVSS are applied as the third voltage V3, and the data signal data[j] is applied as the first voltage V1. As the switching transistor TR11 is turned on, the first node N11 and the second node N12 are connected. The first power source voltage ELVDD of the third voltage V3 is applied in the light emitting period (c) of the previous frame such that the voltage of the data line Dj is in the state of the third voltage V3. If the data voltage data[j] is applied as the first voltage V1, the voltage of the data line Dj is changed from the third voltage V3 to the first voltage V1, and the voltage of the first node N11 and the second node N12 is decreased to the low level voltage by the coupling due to the compensation capacitor C11.

After the first period (a1'), the link control signal RC is applied as the high level voltage, and the data signal data[j] is applied as the third voltage V3. If the data signal data[j] is applied as the third voltage V3 after the first period (a1'), the voltage of the first node N11 and the second node N12 is increased by the coupling due to the compensation capacitor C11. At this time, the second power source voltage ELVSS is decreased to the first voltage V1, and the voltage of the third node N13 is decreased to the low level voltage by the coupling due to the parasitic capacitance of the organic light emitting diode (OLED).

During the second period (a2') included in the reset period (a), a plurality of scan signals S[1]-S[n] and a plurality of compensation control signals GC[1]-GC[n] are applied as the low level voltage, and the link control signal RC is applied as the high level voltage. At this time, the first power source voltage ELVDD and the second power source voltage ELVSS are applied as the first voltage V1. As the switching transistor TR11 and the compensation transistor TR13 are turned on, the first node N11, the second node N12, and the third node N13 are connected. Although the first node N11 and the second node N12 are increased after the first period (a1'), the third node N13 is in the state of being decreased to the low level voltage, and as the first to third nodes N1, N2, and N3 are connected to each other in the second period a2, the voltage of the first node N11 and the second node N12 is again decreased to the low level voltage.

The operation of the third period (a3') included in the reset period (a), the scan period (b), and the light emitting period (c) is the same as that described in FIG. 4 such that the detailed description is omitted.

Figure 6:
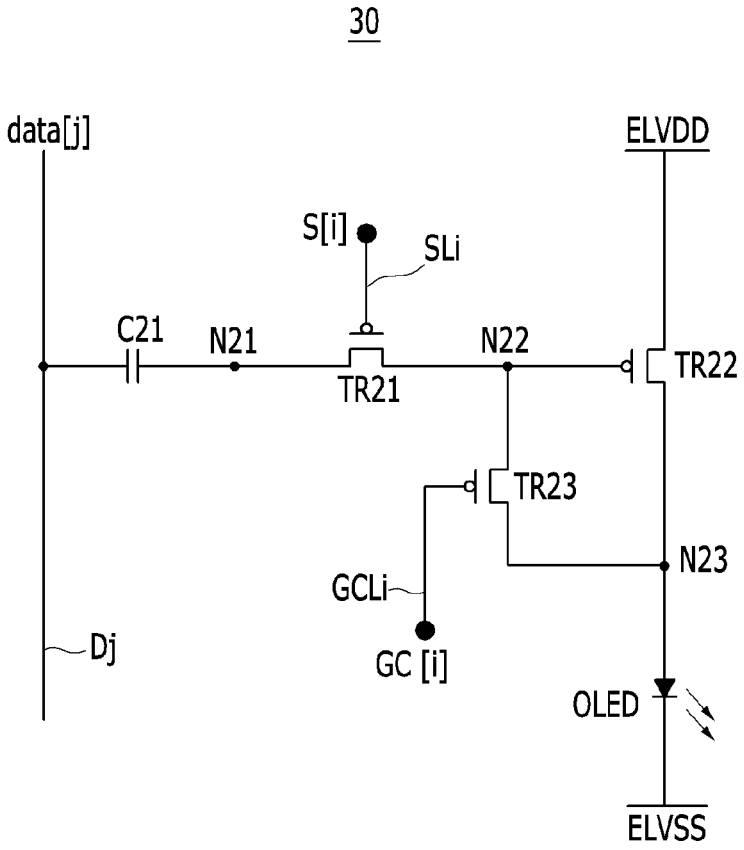
FIG. 6 is a circuit diagram of a pixel according to another exemplary embodiment of the disclosed technology.

FIG. 6 is a circuit diagram of a pixel according to another exemplary embodiment of the disclosed technology.

Referring to FIG. 6, the pixel 30 of FIG. 6 can be formed in the pixel matrix along with the pixel 20 of FIG. 3 to obtain a desired aperture ratio.

The pixel 30 includes a switching transistor TR21, a driving transistor TR22, a compensation transistor TR23, a compensation capacitor C21, and an organic light emitting diode (OLED).

Importantly, compared with the pixel 20 of FIG. 3, the pixel 30 of FIG. 6 does not include the link transistor TR14. That is, the pixel 20 includes four transistors TR11, TR12, TR13, and TR14 and one capacitor C11, however the pixel 30 includes three transistors TR21, TR22, and TR23 and one capacitor C21. The pixel 30 includes one less transistor than the pixel 20 such that the pixel 30 is advantageous to increase the overall aperture ratio of the pixel matrix.

In the pixel 20 of FIG. 3, the power source lines PD1-PDm of the first power source voltage ELVDD and the data lines D1-Dm are electrically connected thereby reducing the voltage drop of the first power source voltage ELVDD. The voltage difference of the first power source voltage ELVDD by the voltage drop is not rapidly generated every pixel and is continuously generated through the entire display unit 700, and accordingly, although the link transistor TR14 is not included in all pixels, but is included in some pixels, the function of reducing the voltage drop of the first power source voltage ELVDD may be sufficient.

Accordingly, the pixel 20 of FIG. 3 and the pixel 30 of FIG. 6 are formed in a proportional mix in the display unit 700 such that a desired aperture ratio may be obtained by reducing the number of transistors along with the function of reducing the voltage drop of the first power source voltage ELVDD.

Next, exemplary embodiments where the pixel 20 of FIG. 3 and the pixel 30 of FIG. 6 are formed in the display unit 700 will be described with reference to FIGS. 7 to 12. For better understanding and ease of description, the pixel 20 is referred to as the first pixel PA and the pixel 30 is referred to as the second pixel PB.

Figure 7:
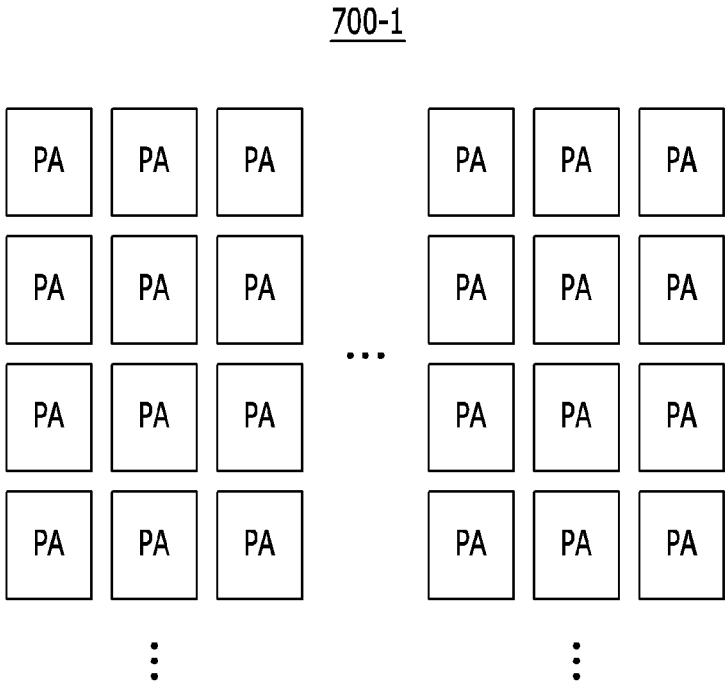
FIG. 7 is a block diagram of a pixel arrangement of a display unit according to an exemplary embodiment of the disclosed technology.
Figure 8:
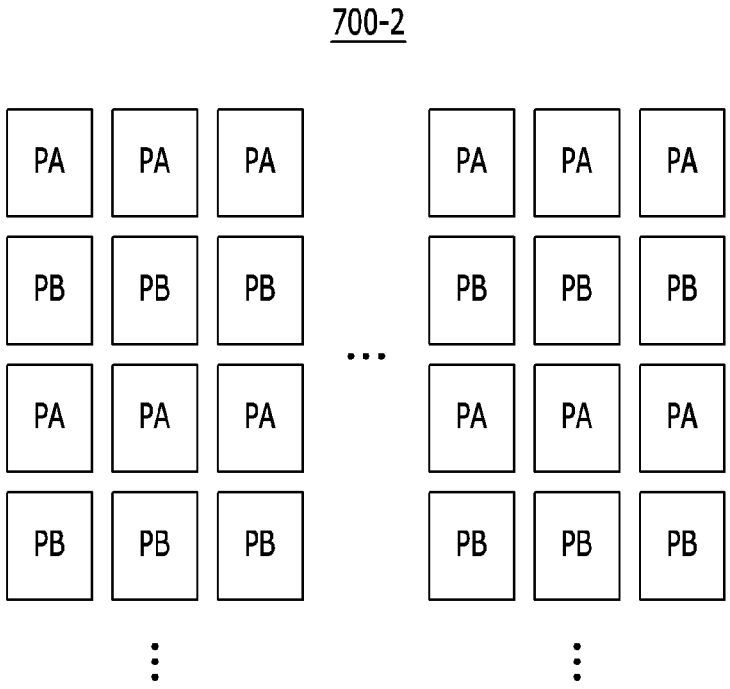
FIG. 8 is a block diagram of a pixel arrangement of a display unit according to an exemplary embodiment of the disclosed technology.
Figure 9:
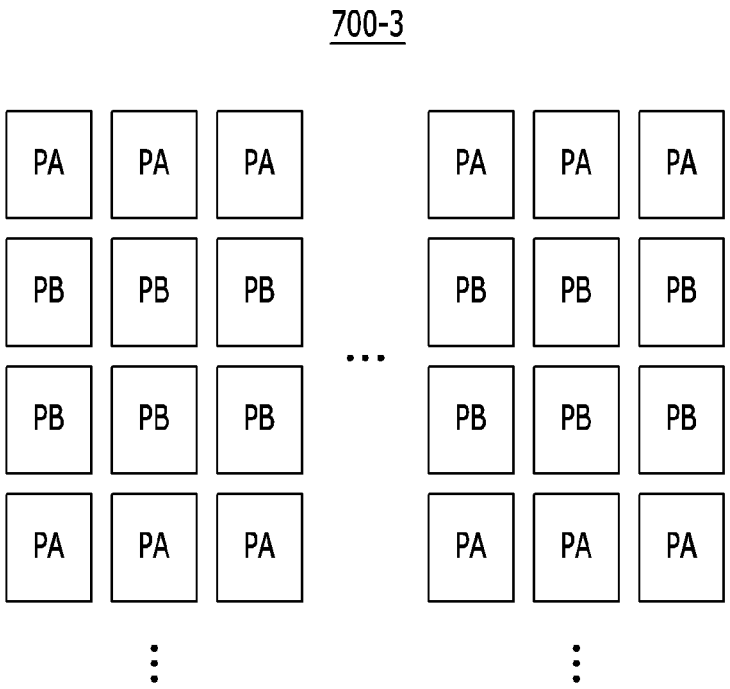
FIG. 9 is a block diagram of a pixel arrangement of a display unit according to an exemplary embodiment of the disclosed technology.
Figure 10:
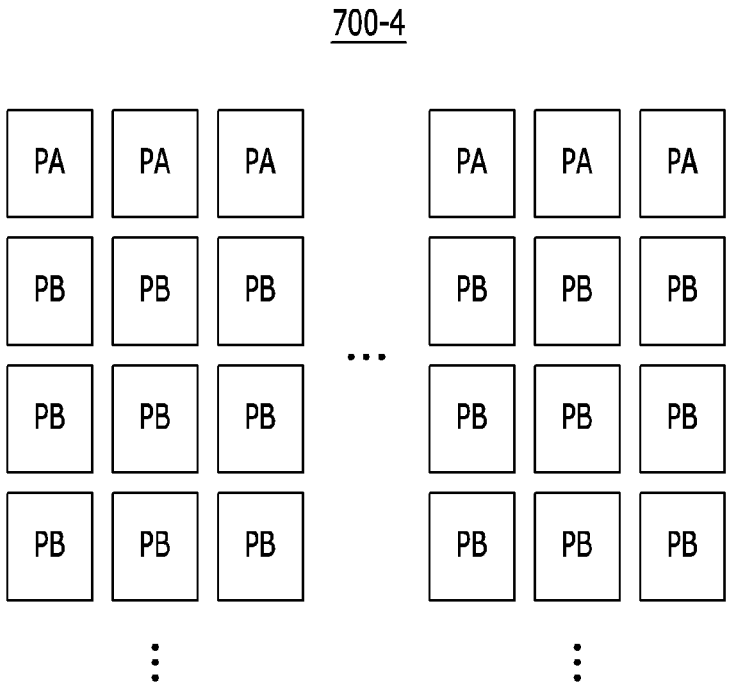
FIG. 10 is a block diagram of a pixel arrangement of a display unit according to an exemplary embodiment of the disclosed technology.
Figure 11:
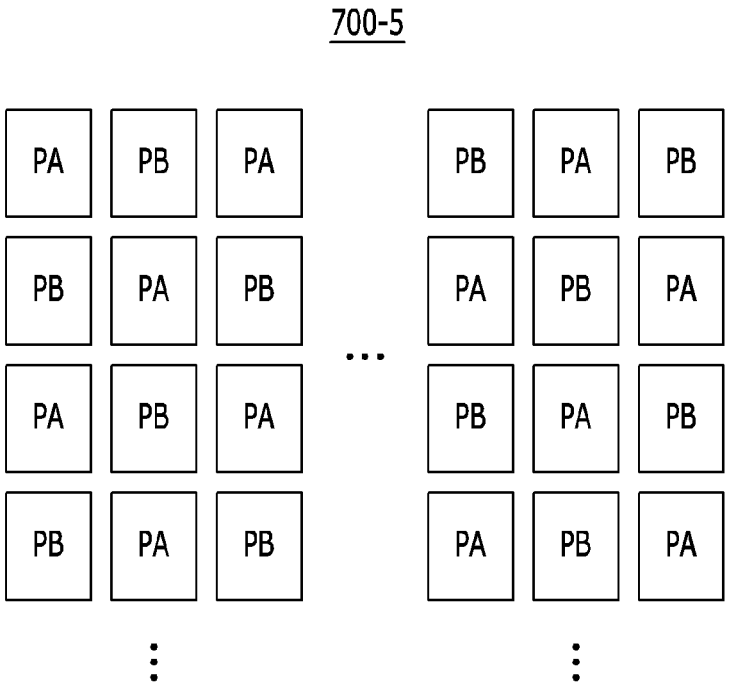
FIG. 11 is a block diagram of a pixel arrangement of a display unit according to an exemplary embodiment of the disclosed technology.
Figure 12:
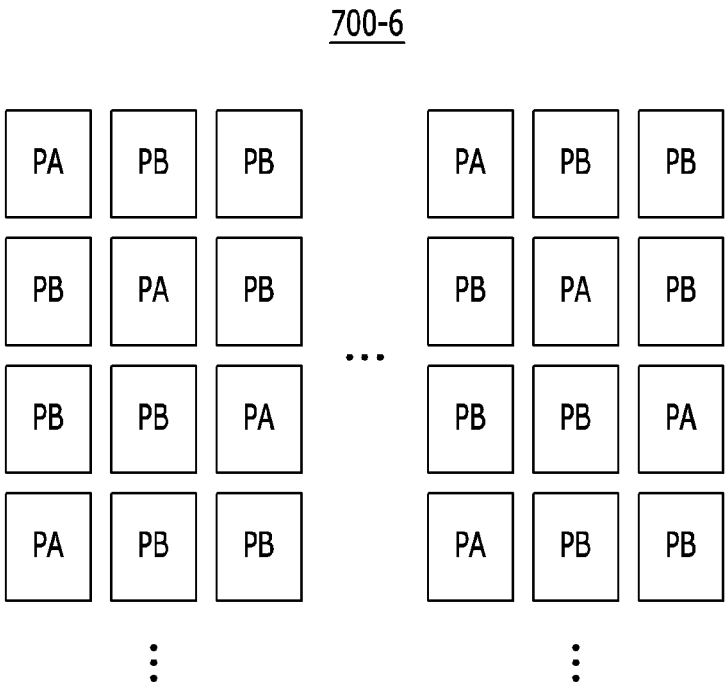
FIG. 12 is a block diagram of a pixel arrangement of a display unit according to an exemplary embodiment of the disclosed technology.

FIG. 7 is a block diagram of a pixel arrangement of a display unit according to an exemplary embodiment of the disclosed technology. FIG. 8 is a block diagram of a pixel arrangement of a display unit according to another exemplary embodiment of the disclosed technology. FIG. 9 is a block diagram of a pixel arrangement of a display unit according to another exemplary embodiment of the disclosed technology. FIG. 10 is a block diagram of a pixel arrangement of a display unit according to another exemplary embodiment of the disclosed technology. FIG. 11 is a block diagram of a pixel arrangement of a display unit according to another exemplary embodiment of the disclosed technology. FIG. 12 is a block diagram of a pixel arrangement of a display unit according to another exemplary embodiment of the disclosed technology.

Referring to FIG. 7, all pixels included in the display unit 700-1 consist of the first pixel PA. Each pixel includes four transistors and one capacitor.

Referring to FIG. 8, the first pixel PA and the second pixel PB are alternately formed row by row in the display unit 700-2. Of course, the first pixel PA and the second pixel PB may be alternately formed column by column in the display unit 700-2. By considering the entire display unit 700-2, each pixel may be considered in a theoretical sense to include 3.5 transistors and one capacitor on average.

Referring to FIG. 9, the first pixel PA of one row and the second pixel PB of two rows are alternately formed in the display unit 700-3. Also, the first pixel PA of one column and the second pixel PB of two columns are alternately formed in the display unit 700-3. By considering the entire display unit 700-3, each pixel may be considered in a theoretical sense to include 3.3 transistors and one capacitor on average.

Referring to FIG. 10, the first pixel PA of one row and the second pixel PB of three rows are alternately formed in the display unit 700-4. Also, the first pixel PA of one column and the second pixel PB of three columns are alternately formed in the display unit 700-4. By considering the entire display unit 700-4, each pixel may be considered in a theoretical sense to include 3.25 transistors and one capacitor on average.

Referring to FIG. 11, the first pixel PA and the second pixel PB are alternately formed in the row direction or the column direction in the display unit 700-5. By considering the entire display unit 700-5, each pixel may be considered in a theoretical sense to include 3.5 transistors and one capacitor on average.

Referring to FIG. 12, one first pixel PA and two second pixels PB are alternately formed in the row direction in the display unit 700-6. Also, one first pixel PA and two second pixels PB are alternately formed in the column direction in the display unit 700-6. By considering the entire display unit 700-6, each pixel may be considered in a theoretical sense to include 3.33 transistors and one capacitor on average.

By considering the entire display unit, as the average number of transistors is decreased per pixel, a desired aperture ratio may be further obtained. Also, as the number of first pixels PA is increased in the display unit, the function of reducing the voltage drop of the first power source voltage ELVDD becomes more effective.

By considering the function of reducing the voltage drop of the first power source voltage ELVDD and the aperture ratio, a ratio and the arrangement method of the first pixel PA and the second pixel PB may be variously determined. Also, the ratio and the arrangement method of the first pixels PA and the second pixels PB may be variously determined according to an area (size) of the display unit or constraints associated with the production process.

Figure 13:
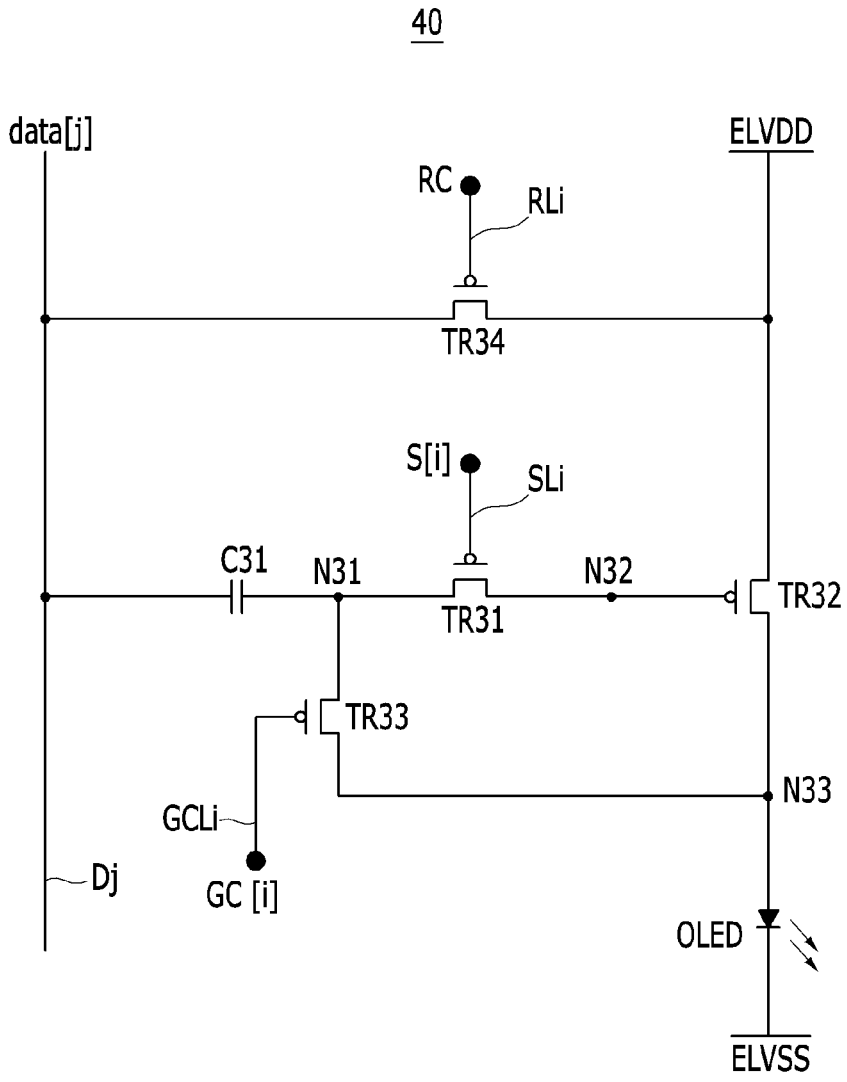
FIG. 13 is a circuit diagram of a pixel according to another exemplary embodiment of the disclosed technology.

FIG. 13 is a circuit diagram of a pixel according to another exemplary embodiment of the disclosed technology.

Referring to FIG. 13, the pixel 40 includes a switching transistor TR31, a driving transistor TR32, a compensation transistor TR33, a link transistor TR34, a compensation capacitor C31, and an organic light emitting diode (OLED).

The switching transistor TR31 includes the gate electrode connected to the scan line SLi, one electrode connected to the first node N31, and the other electrode connected to the second node N32.

The driving transistor TR32 includes the gate electrode connected to the second node N32, one electrode connected to the first power source voltage ELVDD, and the other electrode connected to the third node N33.

The compensation transistor TR33 includes the gate electrode connected to the compensation control line GCLi, one electrode connected to the first node N31, and the other electrode connected to the third node N33. The compensation transistor TR33 is turned on by the compensation control signal GC of the gate-on voltage to connect the first node N31 and the third node N33.

The link transistor TR34 includes the gate electrode connected to the link control line RLi, one electrode connected to the data line Dj, and the other electrode connected to the first power source voltage ELVDD.

The compensation capacitor C31 includes one electrode connected to the data line Dj and the other electrode connected to the first node N31.

The organic light emitting diode (OLED) includes the anode connected to the third node N33 and the cathode connected to the second power source voltage ELVSS. The organic light emitting diode OLED can emit light having one among primary colors. Examples of the primary colors may include three primary colors of red, green, and blue, and a desired color is displayed by a spatial or temporal sum of these three primary colors.

Compared with the pixel 20 of FIG. 3, in the pixel 40 of FIG. 13, the compensation transistor TR33 connects the first node N31 and the third node N33. Although the compensation transistor TR33 connects the first node N31 and the third node N33, the display device including the pixel 40 of FIG. 13 is operated according to the same driving timing diagram of FIG. 4 or FIG. 5 already described above.

Figure 14:
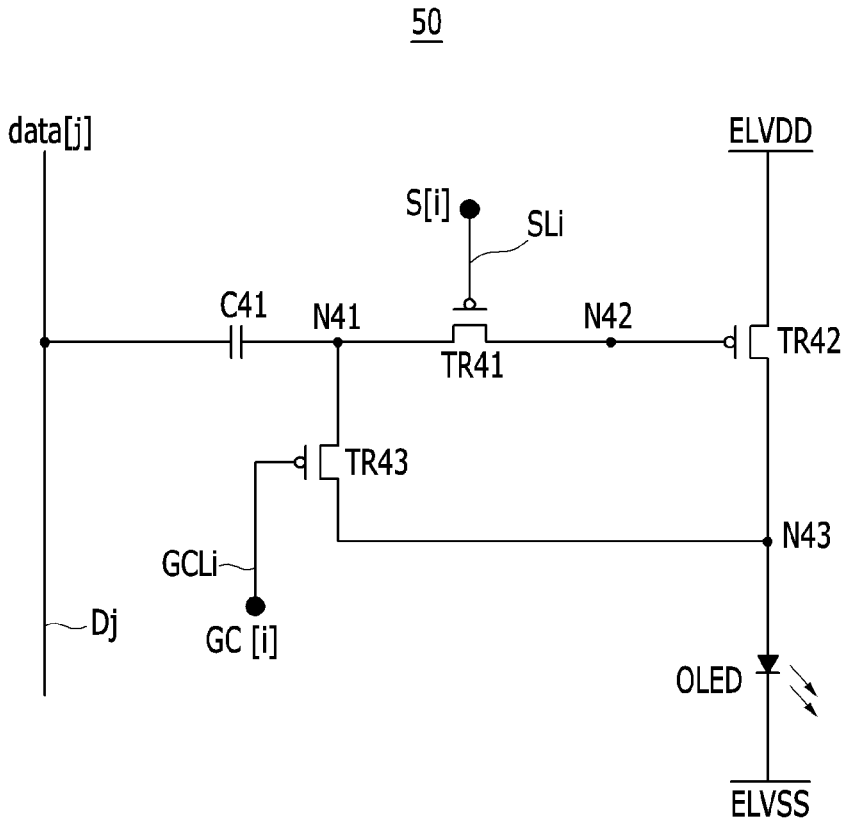
FIG. 14 is a circuit diagram of a pixel according to another exemplary embodiment of the disclosed technology.

FIG. 14 is a circuit diagram of a pixel according to another exemplary embodiment of the disclosed technology.

Referring to FIG. 14, the pixel 50 includes a switching transistor TR41, a driving transistor TR42, a compensation transistor TR43, a compensation capacitor C41, and an organic light emitting diode (OLED).

Compared with the pixel 40 of FIG. 13, the pixel 50 of FIG. 14 does not include the link transistor TR34. That is, the pixel 40 of FIG. 13 includes four transistors TR31, TR32, TR33, and TR34 and one capacitor C31, however the pixel 50 of FIG. 14 includes three transistors TR41, TR42, and TR43 and one capacitor C41.

Compared with the pixel 30 of FIG. 6, in the pixel 50 of FIG. 14, the compensation transistor TR43 connects the first node N41 and the third node N43.

As described in FIGS. 7 to 12, the pixel 40 of FIG. 13 may be formed in the display unit as the first pixel PA, and the pixel 50 of FIG. 14 may be formed in the display unit as the second pixel PB. Also, the pixel 20 FIG. 3 may be formed in the display unit as the first pixel PA, and the pixel 50 of FIG. 14 may be formed in the display unit as the second pixel PB. Also, the pixel 40 FIG. 13 may be formed in the display unit as the first pixel PA, and the pixel 30 of FIG. 6 may be formed in the display unit as the second pixel PB. Of course, the pixel 20 of FIG. 3, the pixel 30 of FIG. 6, the pixel 40 of FIG. 13, and the pixel 50 of FIG. 14 may be formed to be mixed in the display unit.

The drawings referred to hereinabove and the detailed description of the disclosed invention are presented for illustrative purposes only, and are not intended to define meanings or limit the scope of the present invention as set forth in the following claims. Those skilled in the art will understand that various modifications and equivalent embodiments of the present invention are possible. Consequently, the true technical protective scope of the present invention must be determined based on the technical spirit of the appended claims.

What is claimed is:

1. A display device comprising a display unit including a plurality of pixels, wherein at least one first pixel among the plurality of pixels comprises:

a first compensation capacitor including one electrode connected to a data line and the other electrode connected to a first node;

a first switching transistor including a gate electrode configured to have a scan signal applied, one electrode connected to the first node, and the other electrode connected to a second node;

a first driving transistor including a gate electrode connected to the second node, one electrode connected to a first power source voltage, and the other electrode connected to a first organic light emitting diode (OLED); and a first link transistor including a gate electrode configured to have a link control signal applied, one electrode connected to the data line, and the other electrode directly connected to the first power source voltage, wherein the first pixel is configured to be driven via a reset period, the reset period including:

a period in which the first link transistor and the first switching transistor are turned-on and the first power source voltage is applied as a first voltage; and a period in which the voltage of the second node is decreased to a low level voltage by coupling due to the compensation capacitor.

2. The display device of claim 1, wherein the first pixel further comprises a first compensation transistor including a gate electrode applied with a compensation control signal, one electrode connected to the second node, and the other electrode connected to the other electrode of the first driving transistor.

3. The display device of claim 1, wherein the first pixel further comprises a first compensation transistor including a gate electrode applied with the compensation control signal, one electrode connected to the first node, and the other electrode connected to the other electrode of the first driving transistor.

4. The display device of claim 1, wherein at least one second pixel among the plurality of pixels comprises:

a second compensation capacitor including one electrode connected to the data line and the other electrode connected to a fourth node;

a second switching transistor including a gate electrode configured to have the scan signal applied, one electrode connected to the fourth node, and the other electrode connected to a fifth node; and a second driving transistor including the gate electrode connected to the fifth node, one electrode connected to the first power source voltage, and the other electrode connected to a second organic light emitting diode (OLED).

5. The display device of claim 4, wherein the second pixel further comprises:

a second compensation transistor including a gate electrode configured to have a compensation control signal applied, one electrode connected to the fifth node, and the other electrode connected to the other electrode of the second driving transistor.

6. The display device of claim 4, wherein the second pixel further comprises a second compensation transistor including a gate electrode applied with a compensation control signal, one electrode connected to the fourth node, and the other electrode connected to the other electrode of the second driving transistor.

7. The display device of claim 4, wherein the first pixel and the second pixel are alternately formed row by row in the display unit.

8. The display device of claim 4, wherein the first pixel of one row and the second pixel of a plurality of rows are alternately formed in the display unit.

9. The display device of claim 4, wherein the first pixel and the second pixel are alternately formed in the display unit in the row direction.

10. The display device of claim 4, wherein the first pixel and the second pixel are alternately formed in the display unit in the column direction.

11. A method of driving a display device including a plurality of pixels respectively including a compensation capacitor connected between a data line and a first node, a switching transistor connecting the first node and a second node according to a scan signal, a driving transistor controlling a driving current flowing from a first power source voltage to a third node connected to an organic light emitting diode (OLED) according to a voltage of the second node, a link transistor transmitting the first power source voltage to the data line according to a link control signal, and a compensation transistor connecting the second node and the third node according to a compensation control signal, the method comprising:

a reset period in which the voltage of the second node is reset as a low level voltage and a voltage of the third node is reset as a voltage corresponding to a sum of a second voltage and a threshold voltage of the driving transistor;

a scan period in which a voltage reflecting a data voltage and a threshold voltage of the driving transistor is stored to the compensation capacitor; and a light emitting period in which a plurality of pixels simultaneously emit light, wherein the reset period comprises:

a period in which the link control signal and the scan signal are applied as a gate-on voltage, and the first power source voltage is applied as a first voltage; and a period in which the voltage of the second node is decreased to the low level voltage by coupling due to the compensation capacitor.

12. The method of claim 11, wherein the reset period comprises:

a period in which the second power source voltage connected to a cathode of the organic light emitting diode (OLED) is applied as the low level voltage;

a period in which the compensation control signal is applied as the gate-on voltage; and a period in which the voltage of the third node is reset as the low level voltage.

13. The method of claim 12, wherein the reset period comprises:

a period in which the compensation control signal is applied as a gate-off voltage;

a period in which the second power source voltage is applied as a third voltage;

a period in which the first power source voltage is applied as the first voltage; and a period in which a current flows from the third node to the first power source voltage such that the voltage of the third node is reset as a voltage corresponding to a sum of the second voltage and the threshold voltage of the driving transistor.

14. The method of claim 11, wherein the scan period comprises:

a period in which a scan signal of a gate-on voltage is sequentially applied to a plurality of scan lines connected to the plurality of pixels;

a period in which the compensation control signal of the gate-on voltage is sequentially applied to a plurality of compensation control lines connected to the plurality of pixels; and a period in which a data signal is applied to the data line corresponding to the scan signal of the gate-on voltage.

15. The method of claim 14, wherein the light emitting period comprises:

a period in which the scan signal of the gate-on voltage is simultaneously applied to the plurality of scan lines;

a period in which the link control signal is applied as the gate-on voltage;

a period in which the first power source voltage is applied as a third voltage and the second power source voltage is applied as the first voltage; and a period in which the current flows to the organic light emitting diode (OLED) through the driving transistor.

16. A pixel, comprising:

a first compensation capacitor including one electrode connected to a data line and the other electrode connected to a first node;

a first switching transistor including a gate electrode configured to have a scan signal applied, one electrode connected to the first node, and the other electrode connected to a second node;

a first driving transistor including a gate electrode connected to the second node, one electrode connected to a first power source voltage, and the other electrode connected to a third node connected to a first organic light emitting diode (OLED); and a first link transistor configured to have a gate electrode applied with a link control signal, one electrode connected to the data line, and the other electrode directly connected to the first power source voltage, wherein the pixel is configured to be driven via a reset period, the reset period including:

a period in which the first link transistor and the first switching transistor are turned-on and the first power source voltage is applied as a first voltage; and a period in which the voltage of the second node is decreased to a low level voltage by coupling due to the compensation capacitor.

17. The pixel of claim 16, further comprising:

a second compensation capacitor including one electrode connected to the data line and the other electrode connected to a fourth node;

a second switching transistor including a gate electrode configured to have the scan signal applied, one electrode connected to the fourth node, and the other electrode connected to a fifth node; and a second driving transistor including the gate electrode connected to the fifth node, one electrode connected to the first power source voltage, and the other electrode connected to a sixth node connected to a second organic light emitting diode (OLED).

18. The pixel of claim 17, further comprising a first compensation transistor including a gate electrode configured to have the compensation control signal applied, one electrode connected to the second node, and the other electrode connected to the third node.

19. The pixel of claim 18, further comprising a second compensation transistor including a gate electrode configured to have the compensation control signal applied, one electrode connected to the fifth node, and the other electrode connected to the sixth node.

20. The pixel of claim 18, further comprising a second compensation transistor including a gate electrode configured to have the compensation control signal applied, one electrode connected to the fourth node, and the other electrode connected to the sixth node.

21. The pixel of claim 17, further comprising a first compensation transistor including a gate electrode configured to have the compensation control signal applied, one electrode connected to the first node, and the other electrode connected to the third node.

22. The pixel of claim 21, further comprising a second compensation transistor including a gate electrode configured to have the compensation control signal applied, one electrode connected to the fifth node, and the other electrode connected to the sixth node.

23. The pixel of claim 21, further comprising a second compensation transistor including a gate electrode configured to have the compensation control signal applied, one electrode connected to the fourth node, and the other electrode connected to the sixth node.

24. The pixel of claim 17, wherein at least one of the first switching transistor, the first driving transistor, the first link transistor, the second switching transistor, the second driving transistor, and a second link transistor is an oxide thin film transistor.

* * * * *